US007293721B2

(12) United States Patent
Roberts

(10) Patent No.: US 7,293,721 B2
(45) Date of Patent: Nov. 13, 2007

(54) CHECK VALVE ASSEMBLY FOR SPRINKLER HEAD

(76) Inventor: James C Roberts, 2822 Pasatiempo Glen, Escondido, CA (US) 92025-7356

( * ) Notice: Subject to any disclaimer, the term of this patent is extended or adjusted under 35 U.S.C. 154(b) by 0 days.

(21) Appl. No.: 10/973,546

(22) Filed: Oct. 26, 2004

(65) Prior Publication Data

US 2006/0086832 A1 Apr. 27, 2006

(51) Int. Cl.
*B05B 15/10* (2006.01)

(52) U.S. Cl. ..... 239/204; 239/203; 239/205; 239/570; 239/579; 137/71; 251/149.2

(58) Field of Classification Search ..... 239/204, 239/203, 205, 201, 533.15, 570; 169/37; 137/68.14, 571, 71, 517; 251/149.6, 149.4, 251/149.2

See application file for complete search history.

(56) References Cited

U.S. PATENT DOCUMENTS 1,432,386 A * 10/1922 Curney ..... 169/37
4,064,889 A 12/1977 Gayle et al.
4,143,853 A * 3/1979 Abramson ..... 251/149.1
4,171,775 A 10/1979 Unruh
4,316,579 A 2/1982 Ray et al.
4,479,611 A 10/1984 Galvis
4,562,962 A 1/1986 Hartman
4,699,321 A 10/1987 Bivens et al.
4,736,889 A 4/1988 Stephenson
4,830,046 A 5/1989 Holt
4,842,198 A 6/1989 Chang
4,848,661 A 7/1989 Palmer et al.
4,852,602 A 8/1989 McKinnon
4,867,603 A 9/1989 Chang
4,944,327 A 7/1990 Gyben
5,174,500 A 12/1992 Yianilos
5,335,857 A 8/1994 Hagon
5,372,306 A 12/1994 Yianilos
5,758,682 A 6/1998 Cain
5,857,487 A 1/1999 Carson et al.
6,000,632 A 12/1999 Wallace
6,024,175 A * 2/2000 Moore et al. ..... 169/37
6,029,749 A 2/2000 Reilly et al.
6,138,924 A 10/2000 Hunter et al.
6,158,520 A 12/2000 Reilly et al.
6,178,982 B1 * 1/2001 Longstreth ..... 137/68.14
6,179,221 B1 1/2001 Goldberg et al.
6,263,912 B1 7/2001 Brown et al.

(Continued)

*Primary Examiner*—Dinh Q. Nguyen
(74) *Attorney, Agent, or Firm*—Gordon & Rees LLP

(57) ABSTRACT

A check valve assembly has a coupling sleeve with a first end for connection to a pop-up or fixed sprinkler head and a second end for connection to a water supply, the coupling sleeve incorporating a valve seat. A disc valve is retained below the valve seat, and a separate actuator is movably mounted above the seat for movement between an operative position extending through the valve seat to hold the valve in the open position, and an inoperative, retracted position. The disc valve is retained against the valve seat around its peripheral edge, and has a central portion which is moved by the actuator into the open position when the sprinkler head is properly connected to the coupling sleeve. Release or removal of the actuator as a result of removal of the sprinkler head will allow fluid pressure at the second end of the coupling sleeve to urge the valve into the closed position.

19 Claims, 20 Drawing Sheets

U.S. PATENT DOCUMENTS 6,536,533 B2 3/2003 Reilly
6,536,534 B1 * 3/2003 Sundholm ..... 169/37
6,568,608 B2 5/2003 Sirkiin
6,682,106 B2 1/2004 Parker

* cited by examiner

CHECK VALVE ASSEMBLY FOR SPRINKLER HEAD

BACKGROUND OF THE INVENTION

The present invention relates generally to all sprinkler heads for all types of irrigation systems. It applies to pop-up and fixed sprinkler heads where a check valve would make the system easier to manage.

In a sprinkler system, a series of pop-up or fixed sprinkler heads are positioned at spaced intervals over an area to be irrigated, such as a lawn, garden, growing fields on farms, or the like. The sprinkler heads are supplied from a single water source via buried water supply pipes which have spaced outlets connected to the sprinkler heads. If maintenance is required due to a broken or clogged sprinkler head, the entire water supply must be turned off while the maintenance is carried out, then turned on again after the sprinkler head is repaired or replaced. This is inconvenient for the worker.

Since sprinkler heads are located above ground level, they are often accidentally broken. If a sprinkler head is damaged or not in place when the water supply is turned on by an automatic timer, water will gush out of the outlet, resulting in waste of water and potential damage to a lawn or plants in the vicinity.

Check valve devices have been proposed in the past for shutting off water supply to a sprinkler outlet in the event that the sprinkler head is displaced or removed. However, these are of relatively complex design and may be expensive to install.

SUMMARY OF THE INVENTION

It is an object of the present invention to provide a new and improved check valve assembly for a pop-up or fixed sprinkler head.

According to one aspect of the present invention, a check valve assembly is provided which comprises a coupling sleeve having a first end for connection to a pop-up or fixed sprinkler head and a second end for connection to a water supply, the coupling sleeve incorporating a valve seat, a disc valve mounted below the valve seat for movement between open and closed positions, and a separate actuator movably mounted above the seat for movement between an operative position extending through the valve seat to hold the valve in the open position, and an inoperative, retracted position. The disc valve is adapted to be retained against the valve seat around its peripheral edge, and has a central portion which is moved by the actuator into an open position when the sprinkler head is properly connected to the coupling sleeve.

In one embodiment of the invention, the disc valve is of rubber or similar resilient material. It may have a ring of spaced openings for allowing water to flow through the valve in the open position, with the actuator forcing the central portion of the valve away from the seat when in the operative position, so as to space the openings from the seat. When the valve is closed, the openings are positioned against the valve seat and no water flow is possible. In an alternative arrangement, the valve may comprise a flapper valve, with the central portion comprising a flap cut out around part of its periphery and secured to the remainder of the valve by a piece of valve material acting as a hinge. When the actuator is held in the operative position, the flap is urged into an open position. When the actuator is retracted, the flap will be biased back into the closed position by water flowing from the water supply, preventing or restricting water flow to the sprinkler outlet.

The actuator may be secured to the end of a sprinkler head or a filter in the sprinkler head, or may be a separate member mounted between the sprinkler head or filter and the valve seat. If the sprinkler head is broken off or removed for maintenance, water flow through the supply pipe will force the valve closed.

The coupling sleeve may be in two parts, comprising a break-away sleeve on which the sprinkler head is mounted, and an inner sleeve having the valve seat and mounted in a lower end of the break-away sleeve. In this case the actuator is mounted between the break-away sleeve and the valve seat, or may be formed integrally with the break-away sleeve. The break-away sleeve has a line of weakness or an annular V-notch around its perimeter at an appropriate point, and will tend to break at this point in the event of any impact which would otherwise tend to break off the sprinkler head. Once the break-away sleeve is broken off, the actuator is released and the biasing force of water on the valve will force the valve into the closed position. If the actuator is formed integrally with the break-away sleeve, it will be broken off together with the sleeve in the event of an impact, so that the valve can be forced shut.

A small orifice may be provided at the center of the valve. This will allow a small stream of water to exit the valve assembly when the valve is closed, facilitating cleaning of a screen filter if used in the assembly. Another advantage of a small central orifice in the valve is that a trickle of water will be seen after a sprinkler head has been broken off, indicating to operators that the sprinkler needs to be repaired at that location. It is otherwise difficult to determine when sprinkler heads are broken, particularly in a large irrigation area.

The check valve assembly of this invention can be readily installed in any sprinkler system with pop-up or fixed sprinkler heads, simply by connecting the coupling sleeve between the water supply and the base of the sprinkler head. The check valve is arranged to close automatically if the sprinkler head is removed for maintenance and to re-open when the sprinkler head is replaced. No separate biasing means is required to urge the check valve into the closed position. Instead, the check valve is a disc valve of resilient or semi-rigid material which has a central region or flap urged away from the valve seat by the actuator. The central region or flap will be urged into the closed position by water pressure at the water supply outlet or riser on release of the actuator by the sprinkler head. In a solid set sprinkler system, where there is a malfunctioning sprinkler, the check valve assembly of this invention allows the malfunctioning sprinkler to be repaired or replaced without shutting down the entire system.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which.

DETAILED DESCRIPTION OF THE DRAWINGS

Figure 1A:
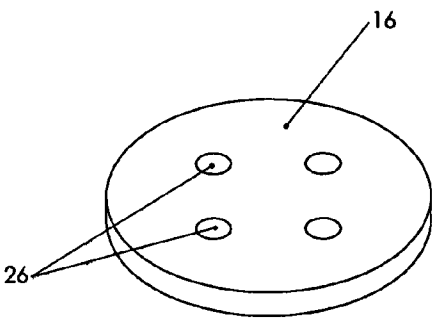
FIG. 1A is an enlarged perspective view of the check valve.
Figure 1:
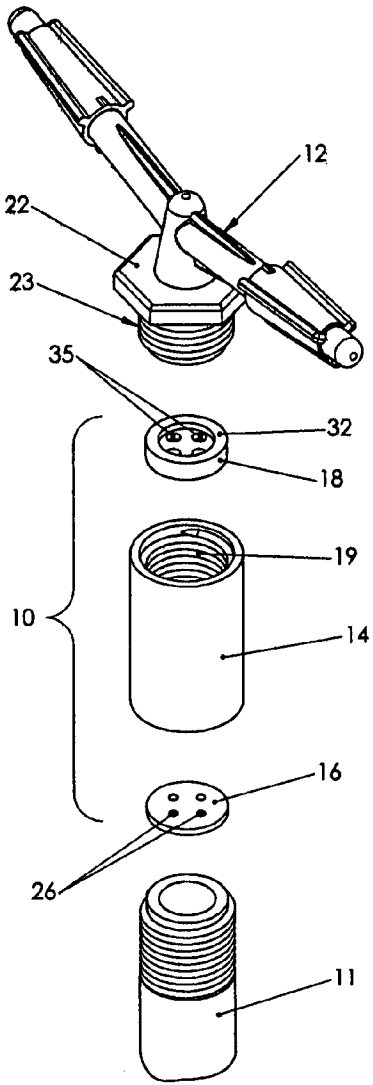
FIG. 1 is an exploded view of a sprinkler head apparatus incorporating a check valve assembly according to a first embodiment of the invention.
Figure 2:
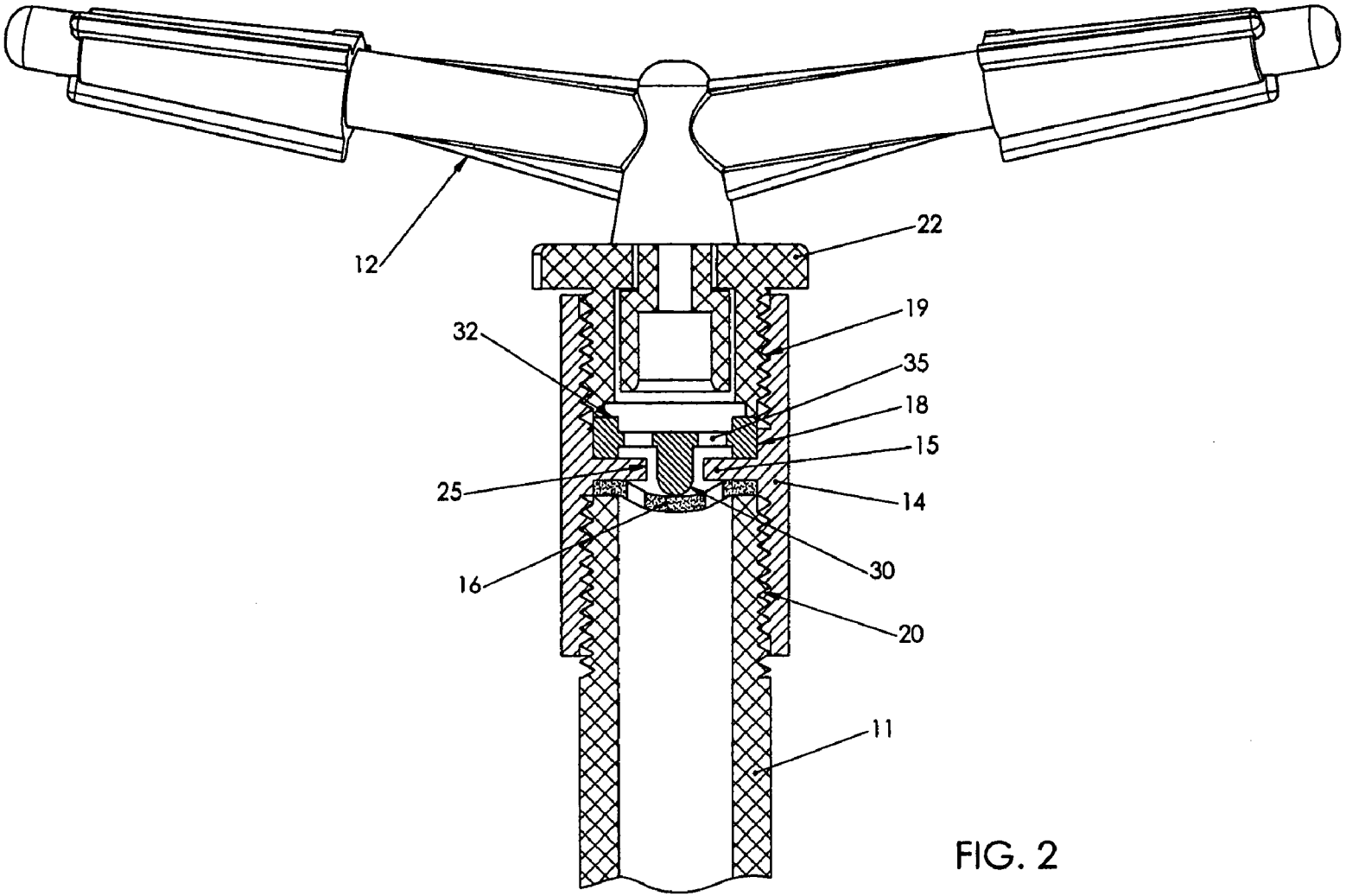
FIG. 2 is a vertical cross-section through the sprinkler head and check valve assembly, showing the valve in an open position.
Figure 3:
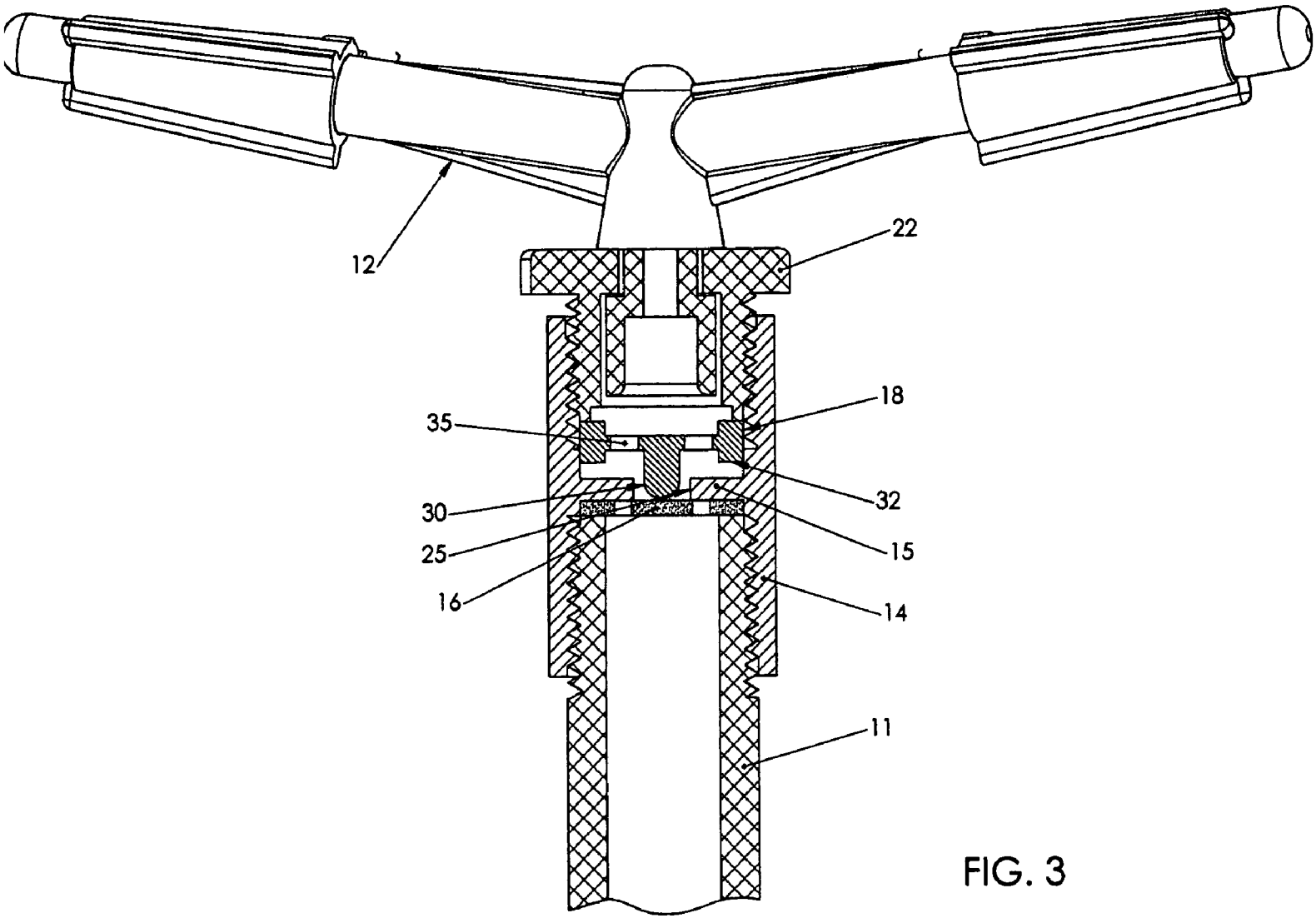
FIG. 3 is a view similar to FIG. 2, showing the valve in a closed position.

FIGS. 1 to 3 of the drawings illustrate a sprinkler head apparatus incorporating a check valve assembly 10 for mounting between a water supply outlet or riser 11 and a pop-up or fixed sprinkler head 12. The check valve assembly 10 basically comprises a coupling sleeve 14 having an internal, annular valve seat or shoulder 15 at an intermediate point in its length, a check valve 16 comprising a flexible disc of rubber or other suitable material mounted beneath the valve seat, and an actuator 18 movably mounted above the valve seat.

The coupling sleeve 14 in the illustrated embodiment has a first set of internal screw threads 19 extending from its upper end and terminating short of the valve seat 15, and a second set of internal screw threads 20 extending from its lower end towards the valve seat 15. The threaded ends of the coupling sleeve 14 are designed for connection to the base 22 of a sprinkler head having external threads 23, and the upper end of a riser or water supply tube 11 of a sprinkler system, as best illustrated in FIGS. 2 and 3. It will be understood that any suitable attachment devices may be provided for securing the coupling sleeve between a sprinkler head and base, and one or both ends may have external rather than internal threads, or other fastener mechanisms.

The valve seat 15 has a central opening 25 over which a central portion of the check valve extends in the closed position. The check valve 16 is a thin disc of flexible material, as noted above, and has a series of spaced openings 26 spaced outwardly from the central region of the disc. The central region of the valve is aligned with the seat opening 25 when the valve is mounted in the coupling sleeve as indicated. When the valve is in the closed position of FIG. 3, the openings 26 will be located against the seat 15 and sealed shut. The valve is seated between the upper end of riser 11 and the valve seat, so that the riser 11 must be screwed into the lower end of the coupling sleeve until it bottoms out against the check valve in order to hold it in place.

The actuator 18 is also comprises a disk-like member. An actuator piston or pin 30 extends axially from the center of one face of the disk towards the valve seat and check valve (see FIGS. 2 and 3). Actuator 18 has an upstanding, annular peripheral rim 32 on each face of the disk. A plurality of spaced openings 35 are provided in the disk around the piston or pin 30. The actuator 18 is slidably mounted in the coupling sleeve 14 above the valve seat, and is normally retained between the lower end of the sprinkler head base 22 and the valve seat 15 when the parts are properly assembled as in FIG. 2.

When the riser 11 is fully engaged in the threaded lower end of the sleeve 14, it will hold the outer rim of the check valve 16 against the valve seat. At the same time, when the sprinkler head is fully engaged in the threaded upper end of the coupling sleeve, it will urge the actuator 18 downwardly into the operative position of FIG. 2, in which the piston 30 bears against the central portion of the valve disk 16 and pushes it downwardly, away from the opening 25 in the valve seat. This allows water to flow to the sprinkler head through the openings 26 in the check valve, the opening 25 in the valve seat, and the openings 35 in the actuator.

If the sprinkler head is removed from the coupling sleeve 14 for any reason, for example for replacement or maintenance, the actuator 18 will be released, and water pressure in the riser or supply pipe 11 will force the center of the check valve upwardly into the closed position, as illustrated in FIG. 3. At the same time, the actuator 18 is pushed upwardly into the retracted or inoperative position. When the sprinkler head is replaced and screwed down into the fully engaged position, the actuator 18 will be pushed back down, forcing the valve back into the open position.

Figure 4:
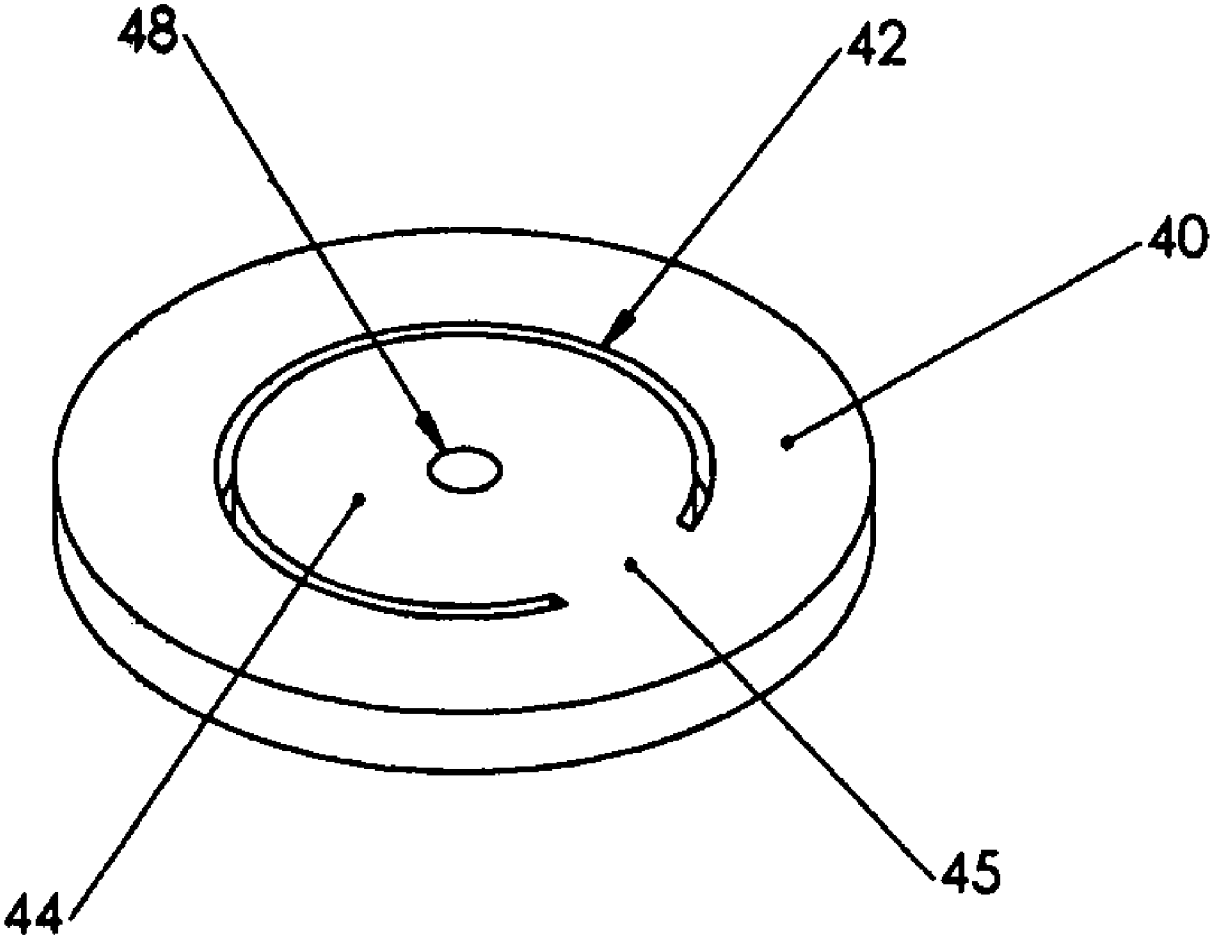
FIG. 4 is a perspective view of a modified check valve, on an enlarged scale.
Figure 5:
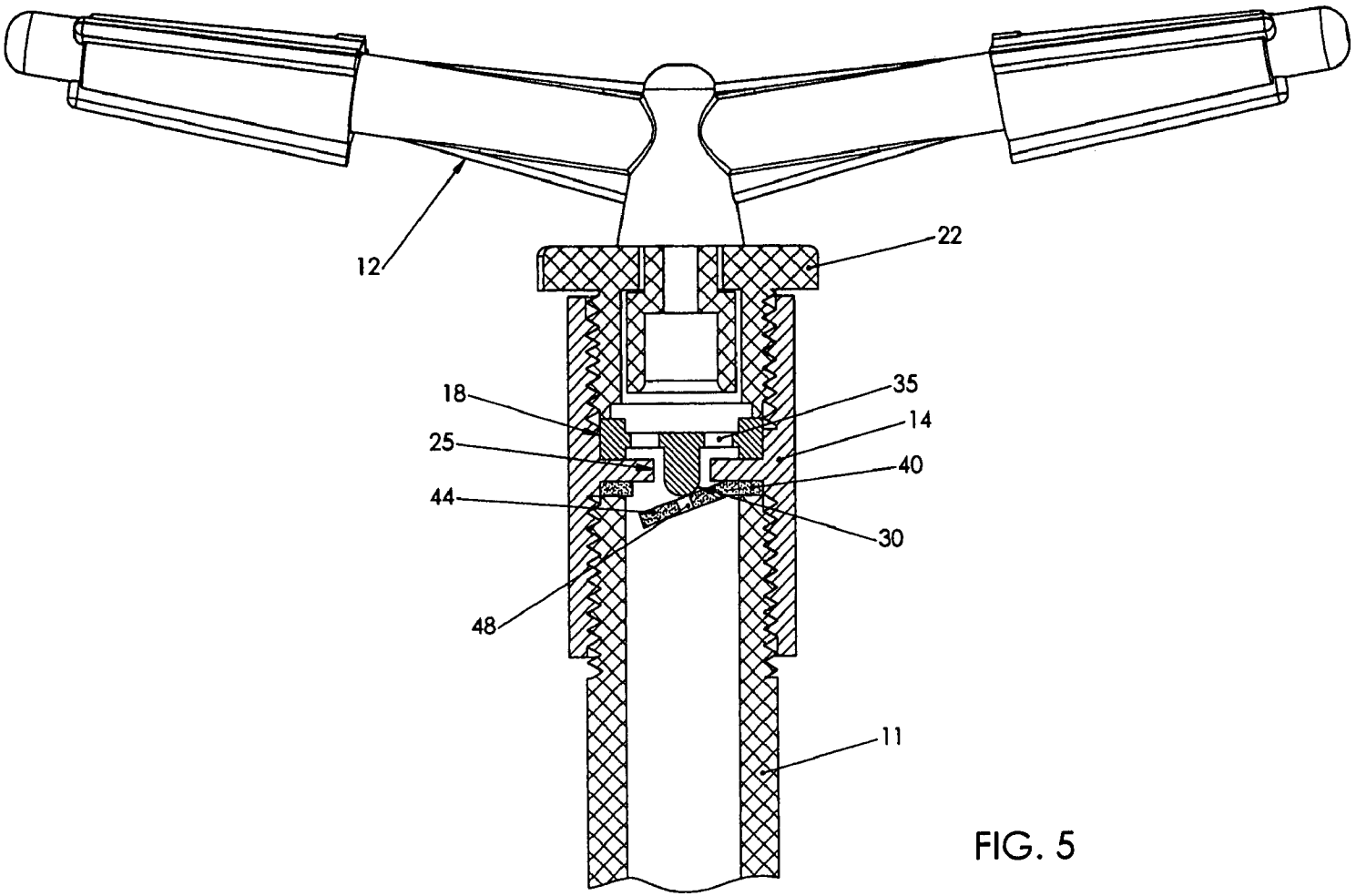
FIG. 5 is a view similar to FIG. 2 but showing the check valve of FIG. 4 installed in the assembly with the valve in an open position.
Figure 6:
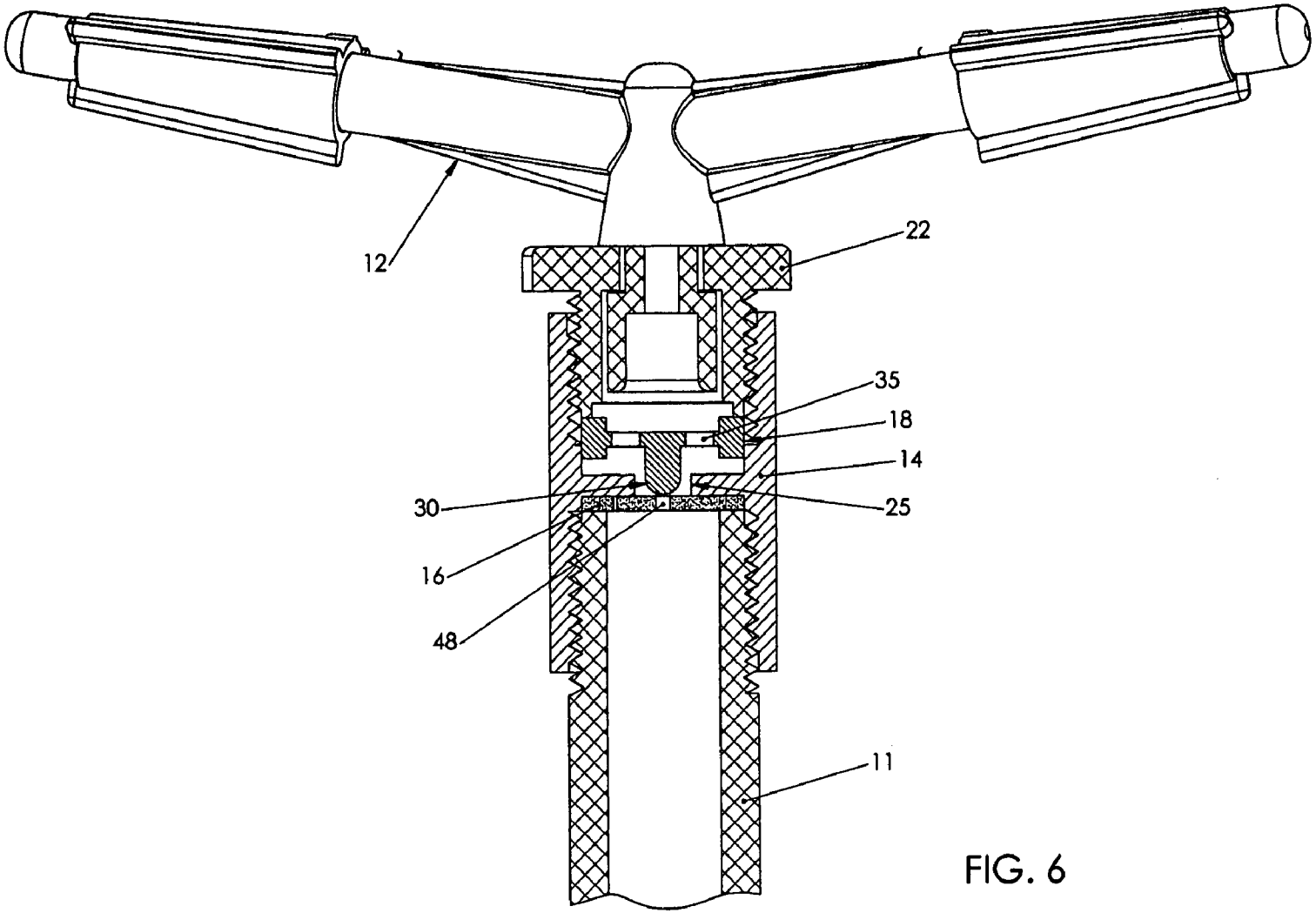
FIG. 6 is a view similar to FIG. 5, showing the valve in a closed position.

FIG. 4 illustrates a modified check valve 40 which may be used in place of valve 16, while FIGS. 5 and 6 illustrate the valve 40 installed in the check valve assembly of the previous embodiment. All other parts of the apparatus in FIGS. 5 and 6 are identical to those of FIGS. 1 to 3, and like reference numerals have been used as appropriate.

The check valve 40 is a flapper valve and may be of flexible or semi-rigid material. As in the previous embodiment, the valve 40 is a generally disc-shaped member. As best illustrated in FIG. 4, a slit 42 is cut out in a circular direction around the center of the valve 40 so as to form a circular flap 44 which is secured to the remainder of the valve by a small web or connecting portion 45 which acts as a hinge. A small central opening or orifice 48 may be provided in flap 44.

In this embodiment, the actuator pin or piston 30 will push the flap 44 down and into the open position when in the operative or extended position of FIG. 5, i.e. when the sprinkler head is properly installed and in position for operation, such that the lower end of base 22 pushes the actuator 18 into the operative position. When the sprinkler supply is turned on, water can then flow past the flap, through the valve and valve opening, and through the openings 35 of the actuator to the sprinkler head. If the sprinkler head is removed for replacement or maintenance, pressure of water in the riser will force the actuator 18 upwardly into the retracted position and the flap 44 back into the closed position, as illustrated in FIG. 6.

The opening or orifice 48 in the flap valve 40 will help an operator to find the location for installation of a replacement sprinkler head or repaired sprinkler head. When the valve 40 is closed by water pressure but no sprinkler head is in place, a small trickle of water will escape through orifice 48, indicating the location of the missing sprinkler head.

Figure 7:
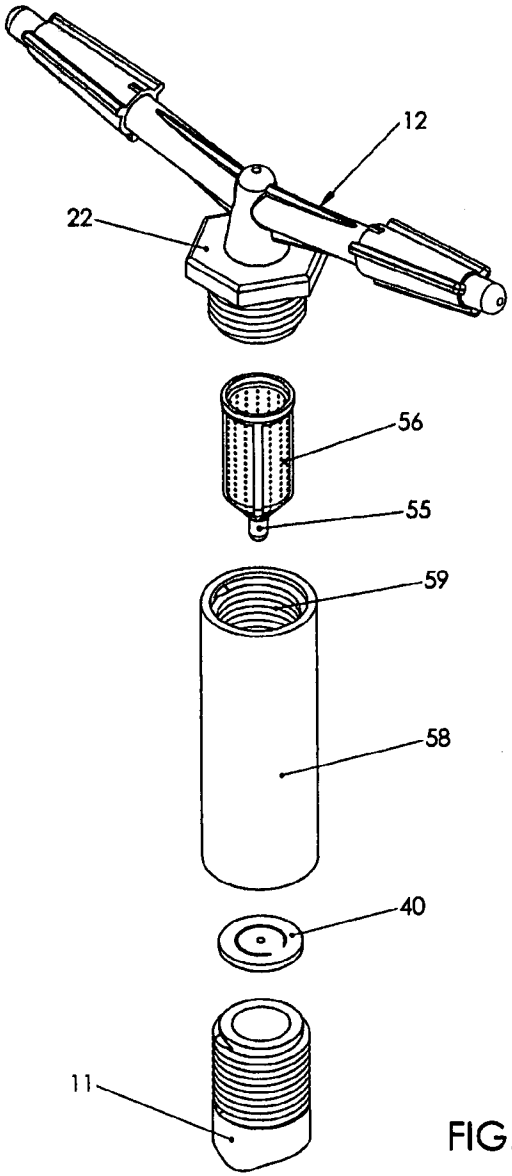
FIG. 7 is an exploded view of a sprinkler head apparatus incorporating a check valve assembly according to a third embodiment of the invention.
Figure 8:
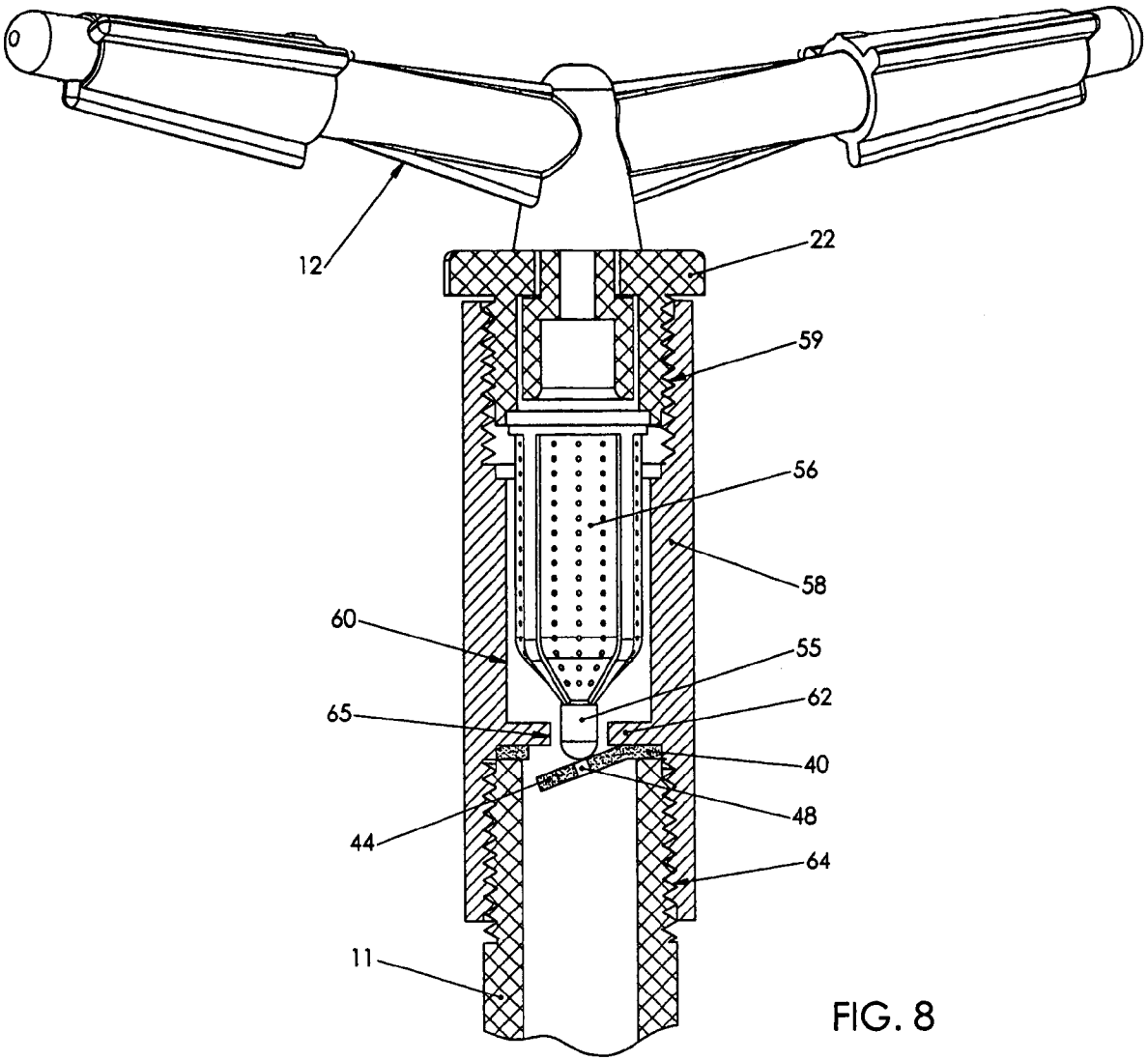
FIG. 8 is a vertical cross-section through the assembled sprinkler head apparatus, showing the check valve in the open position.
Figure 9:
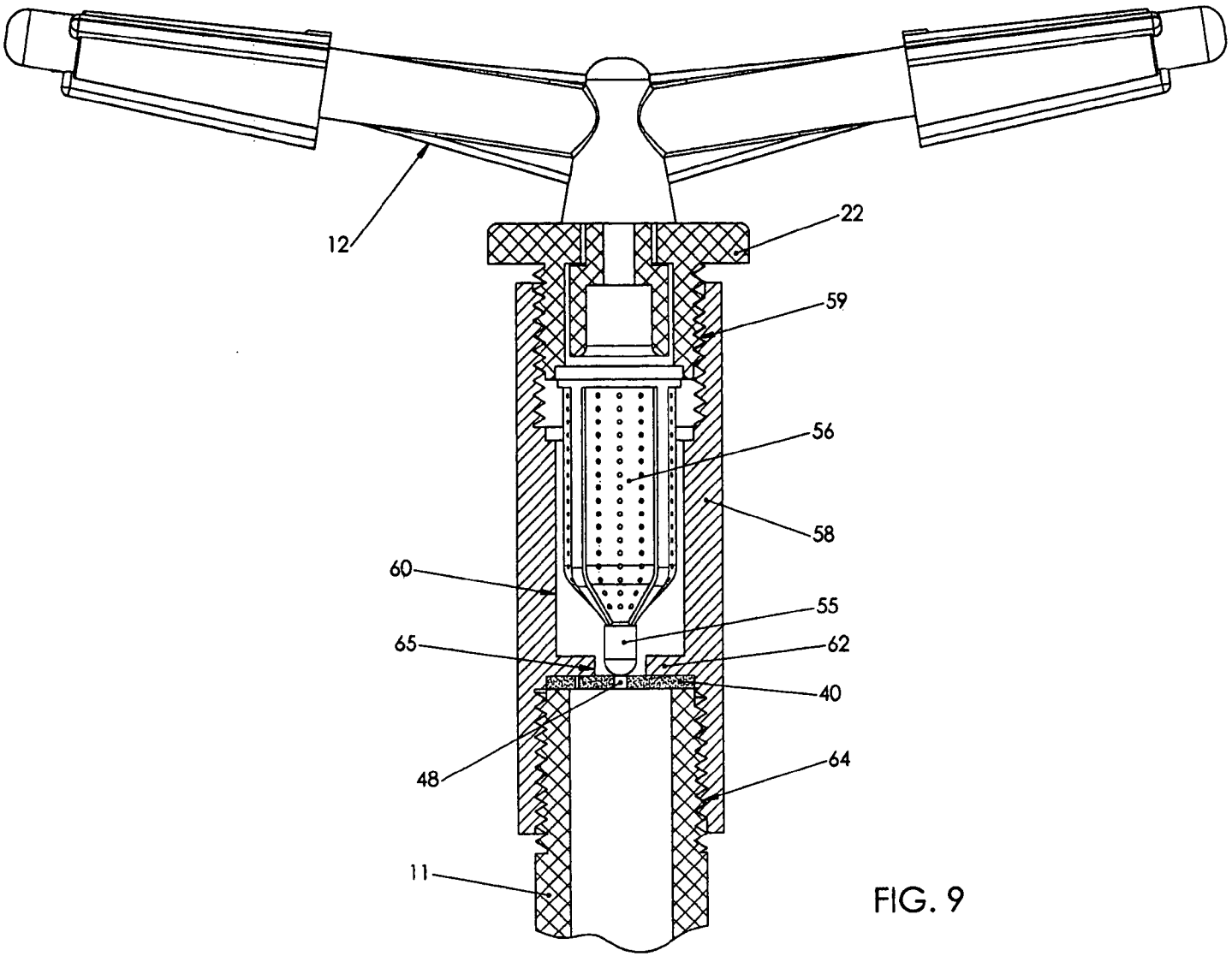
FIG. 9 is a view similar to FIG. 8 but showing the check valve in the closed position.

Rather than having a separate actuator, as in the preceding embodiments, the actuator may be mounted on the sprinkler base or secured on the end of a filter in the sprinkler, it one is present. Alternatively, the actuator may comprise a piston or projection 55 formed integrally on the end of a sprinkler valve filter 56, as illustrated in FIGS. 7 to 9. The coupling sleeve 58 is elongated in this case, and includes a threaded upper portion 59 for receiving the base 22 of the sprinkler head, a cylindrical intermediate portion 60 for receiving the filter 56, and a valve seat 62 separating the intermediate portion 60 from lower threaded portion 64 which engages with the upper end of the water supply pipe or riser 11. A flap valve 40 as in the previous embodiment is mounted below valve seat 62, but this may be replaced with a rubber gasket valve 16 as in the first embodiment.

The valve will operate in exactly the same way as the previous embodiments, with the piston or projection 55 extending through the opening 65 in the valve seat and pushing the flap 44 of valve 40 into the open position when the sprinkler head is properly mounted, as illustrated in FIG. 8. When the sprinkler head, along with the attached filter, is removed from the coupling sleeve for repair, cleaning, or replacement when broken, the actuator piston is also removed, so that water pressure will push the check valve closed, as indicated in FIG. 9.

Figure 10:
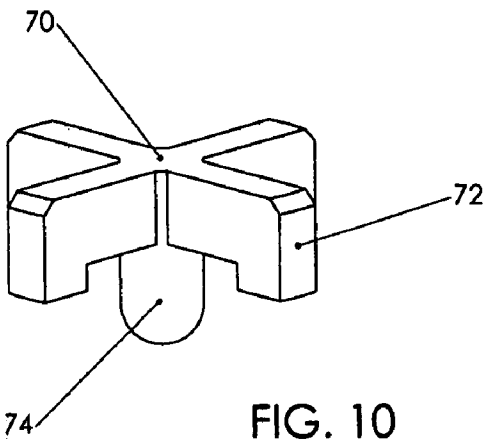
FIG. 10 is a perspective view illustrating a modified actuator for use in the check valve assembly.
Figure 11:
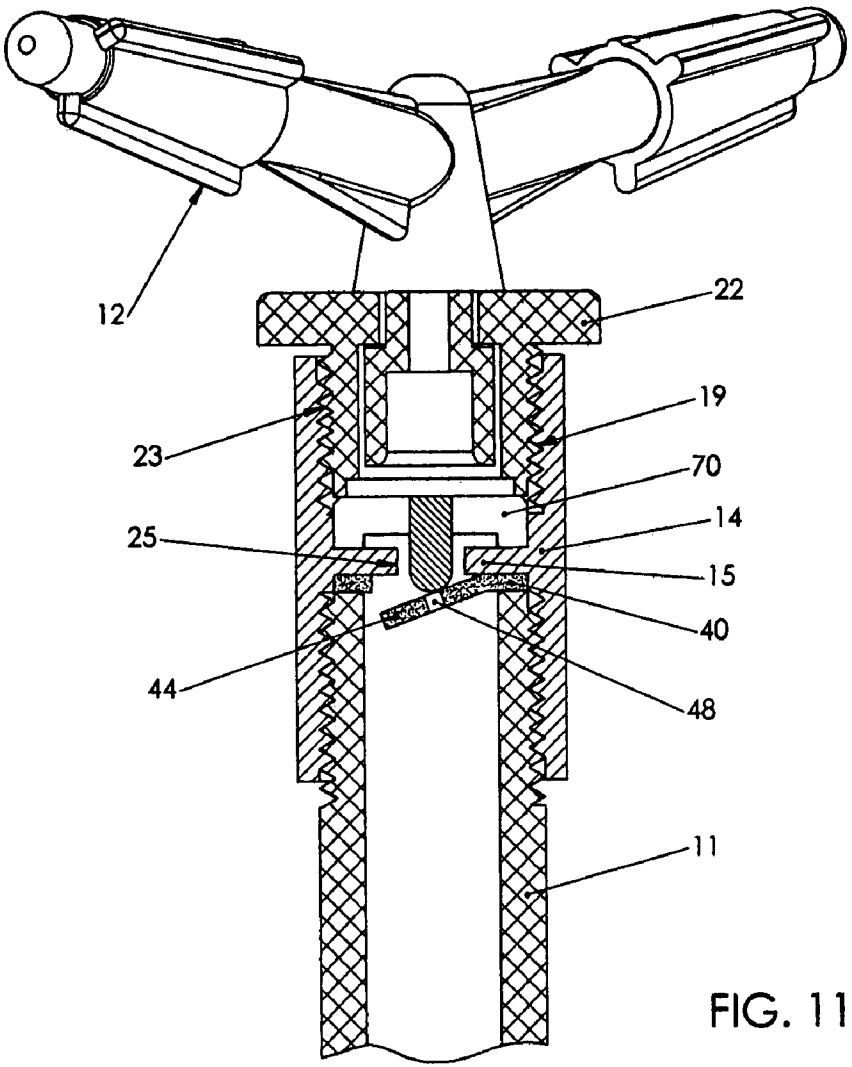
FIG. 11 is a vertical cross-section through an assembled sprinkler head and check valve assembly using the modified actuator of FIG. 10.

FIG. 10 illustrates a modified actuator 70 which may be used in place of the actuator in the embodiments of FIGS. 1 to 6, while FIG. 11 illustrates actuator 70 in place of the actuator 18 in the embodiment of FIGS. 4 to 6. Other parts in FIG. 11 are identical to those of FIGS. 4 to 6, and like reference numerals have been used for like parts as appropriate. Actuator 70 has a body which is generally cross-shaped in cross-section, as best illustrated in FIG. 10, and has four perpendicular flanges or wings 72 instead of a flat disc with openings as in the previous embodiments. An actuator pin or piston 74 projects from the center of the cross shaped body.

FIG. 11 illustrates the actuator 70 mounted between the end of sprinkler head base 22 and the valve seat 15, so that the piston 74 projects through the opening 25 in the valve seat and pushes the valve flap 44 into the open position. If the sprinkler head is removed for replacement or repair, water pressure in riser 11 will act on the flap valve to urge the flap 44 closed and push the actuator 70 upwardly into an inoperative position, in the same manner as illustrated above in FIG. 6.

Figure 12:
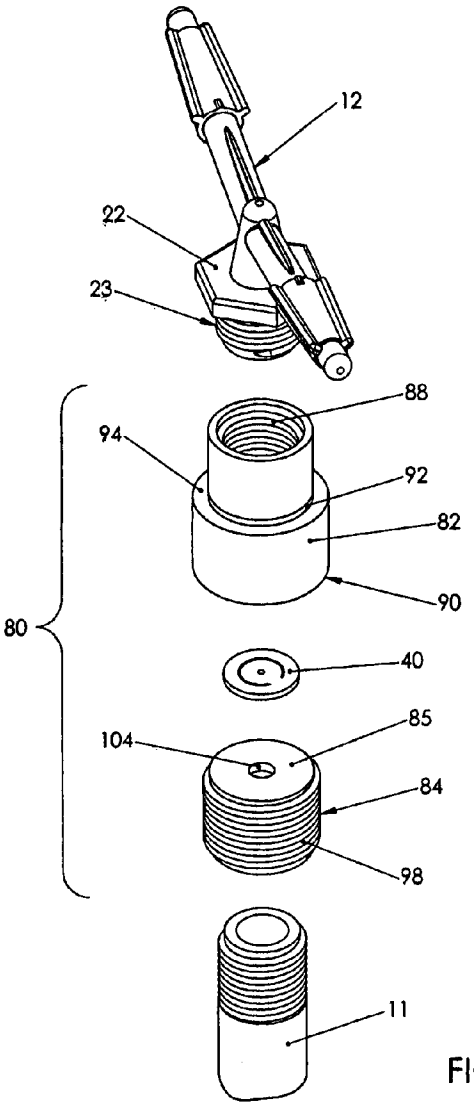
FIG. 12 is an exploded view of a sprinkler head apparatus incorporating a check valve assembly according to another embodiment of the invention.
Figure 13:
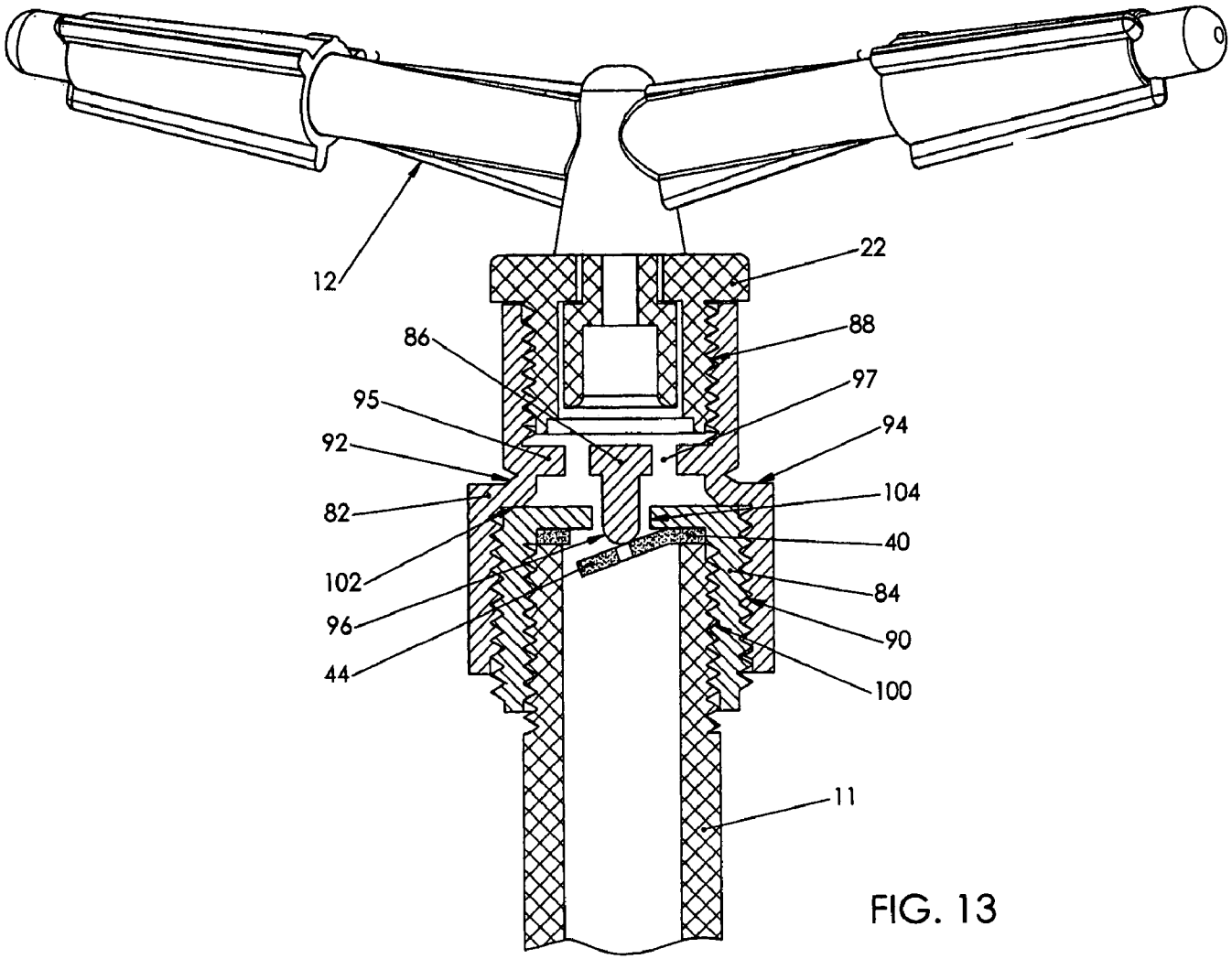
FIG. 13 is a vertical cross-section through the assembled apparatus, showing the check valve in the open position.
Figure 14:
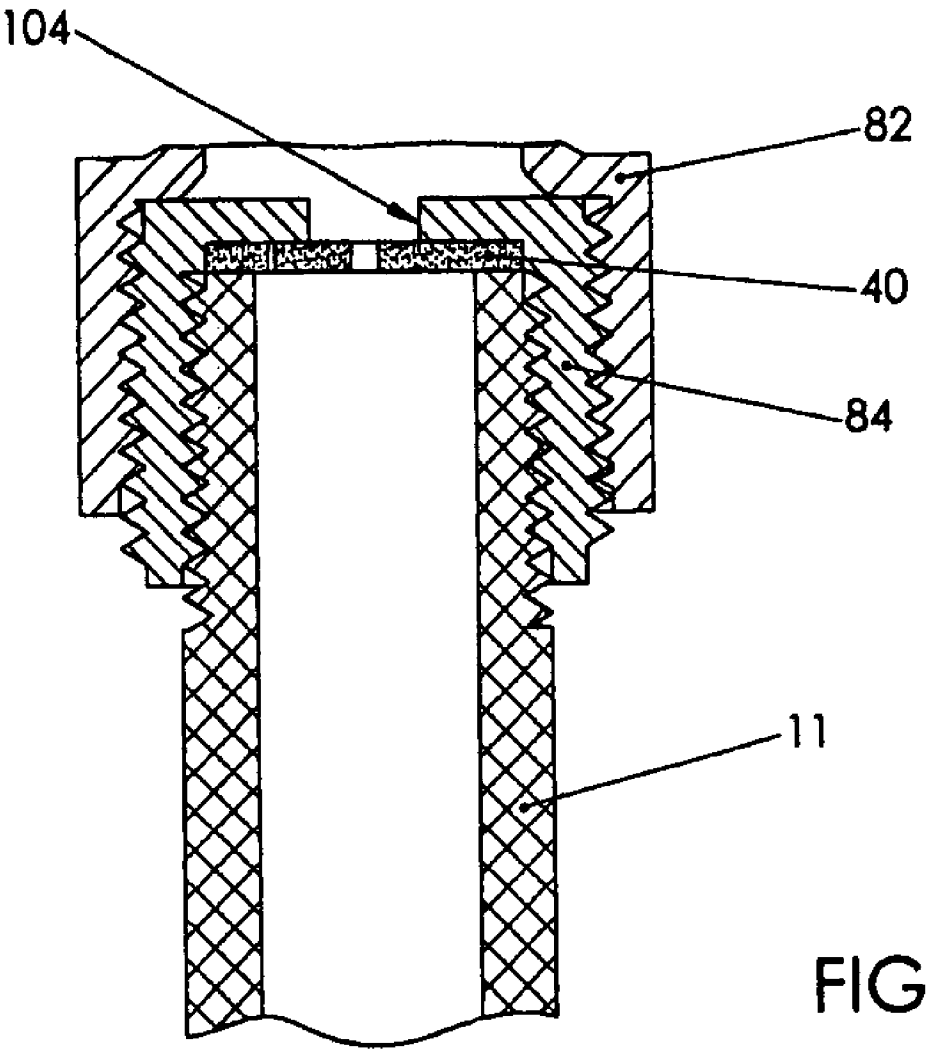
FIG. 14 is a view similar to FIG. 13, illustrating the check valve in the closed position.

In the above embodiments, the check valve assembly is arranged to close if the sprinkler head is removed to replace a broken spray head or for maintenance, cleaning, or other purposes. In these embodiments, the check valve is not actuated when a spray head is broken. In the embodiment of FIGS. 12 to 14, a check valve assembly 80 is illustrated which is arranged to cut off water supply to a sprinkler or spray head if the spray head is broken. FIG. 12 illustrates the check valve assembly 80 separate from the water supply outlet or riser 11 and spray head 12, while FIGS. 13 and 14 illustrate the assembly 80 mounted between the water supply outlet and sprinkler head.

The check valve assembly 80 comprises a replaceable outer body or coupling 82, an internal sleeve or nipple 84 on which the valve seat 85 is located, a valve actuator 86 and a disc valve 40 which is identical to the valve 40 of FIGS. 4 to 6. The disc valve 40 may be replaced by a flexible valve 16 with openings 26, as in the first embodiment above. In this embodiment, the valve actuator 86 is formed integrally with the outer body 82, but it may be formed separately in alternative embodiments.

The outer body 82 has an upper threaded portion 88 of smaller outer diameter for releasable engagement with the base 22 of a sprinkler head, and a lower threaded portion 90 of larger outer diameter for releasable engagement with the nipple or internal sleeve 84. An annular V-indent or line of weakness 92 is provided at the lower end of portion 88 adjacent the shoulder 94 which separates the upper portion 88 from the lower portion 90. The valve actuator 86 comprises a wall 95 extending across the internal passageway in the upper portion 88 of the body at a location adjacent and just above the V-indent 92, and a piston or pin 96 extending downwardly from wall 95. Openings 97 are provided in wall 95 for allowing water flow to the sprinkler head.

As illustrated in the drawings, inner body 84 has outer threads 98 for engaging in the lower end portion 90 of the outer body 82 as well as inner threads 100. When the inner body 84 is fully engaged in the lower end portion 90 of the body 82 until it bottoms out against shoulder 102, the piston 96 will extend downwardly through the opening 104 in valve seat 85. The valve 40 is engaged in the inner end of the body 84 and is held in position by the upper end of riser or water supply pipe 11 which is threadably engaged with the internal threads 100 in body 84. When the parts are fully secured together as in FIG. 13, the piston 96 will engage the flap 44 and push it into the open position so that water can flow through the check valve assembly and into the sprinkler head.

In the event of an impact on the sprinkler head, the assembled sprinkler will tend to break off at the V-indent 92, which is the weakest point. This in turn will also break off the actuator 86 so that the water pressure acting on the valve 40 will urge the flap 44 into the closed position, as illustrated in FIG. 14. The water supply is therefore cut off in the event of an impact sufficient to cause breaking of the sprinkler head. This avoids the problem of water gushing out of a broken sprinkler head each time the sprinkler system is turned on. At the same time, the small orifice 48 at the center of valve 40 will allow a small trickle of water to leak out, so that the broken off sprinkler head can be located more easily. Once the break is located, the broken outer body 82 of the check valve assembly can be discarded and replaced with a new outer body 82, and the sprinkler head can be reinstalled.

In the above break-away version of the check valve assembly, the actuator is formed integrally with the outer body 82 which has the break away feature. However, the actuator may alternatively be formed separately, and may be of the structure described above in any of the previous embodiments. In this case, the outer body will be provided with an internal shoulder just above the V-notch, and the actuator will be held in the extended, operative position by the shoulder. If the outer body is broken off at the V-notch, the actuator will be released and the valve urged into the closed position. It the sprinkler head 12 is to be removed for replacement or maintenance, the operator can simply remove the entire outer body 82 with the sprinkler head so that the valve 40 can be urged closed, preventing water from gushing out of the sprinkler supply outlet.

Figure 15:
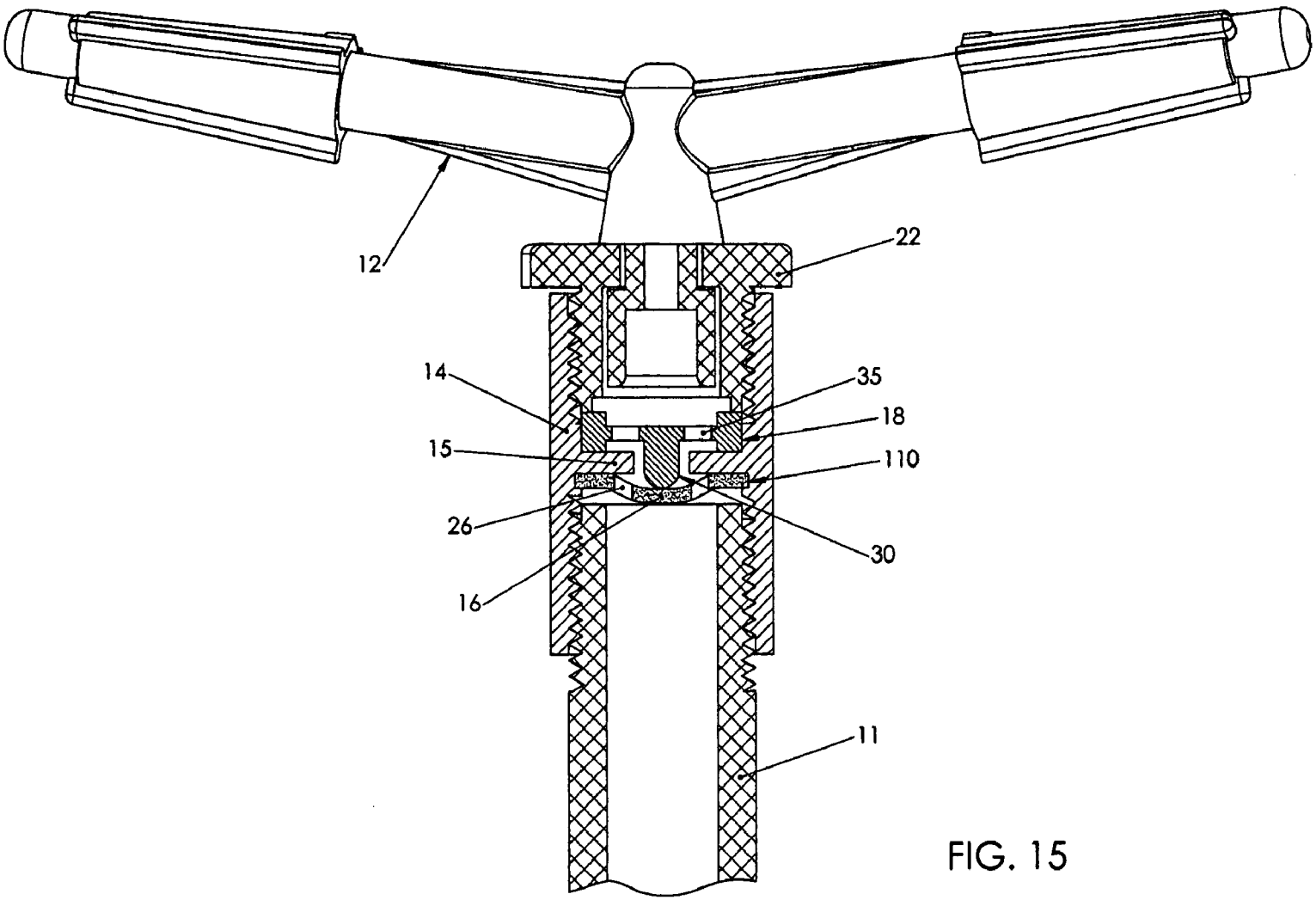
FIG. 15 is a view similar to FIG. 2, illustrating a modified arrangement for mounting the check valve in the embodiment of FIGS. 1 to 3.
Figure 16:
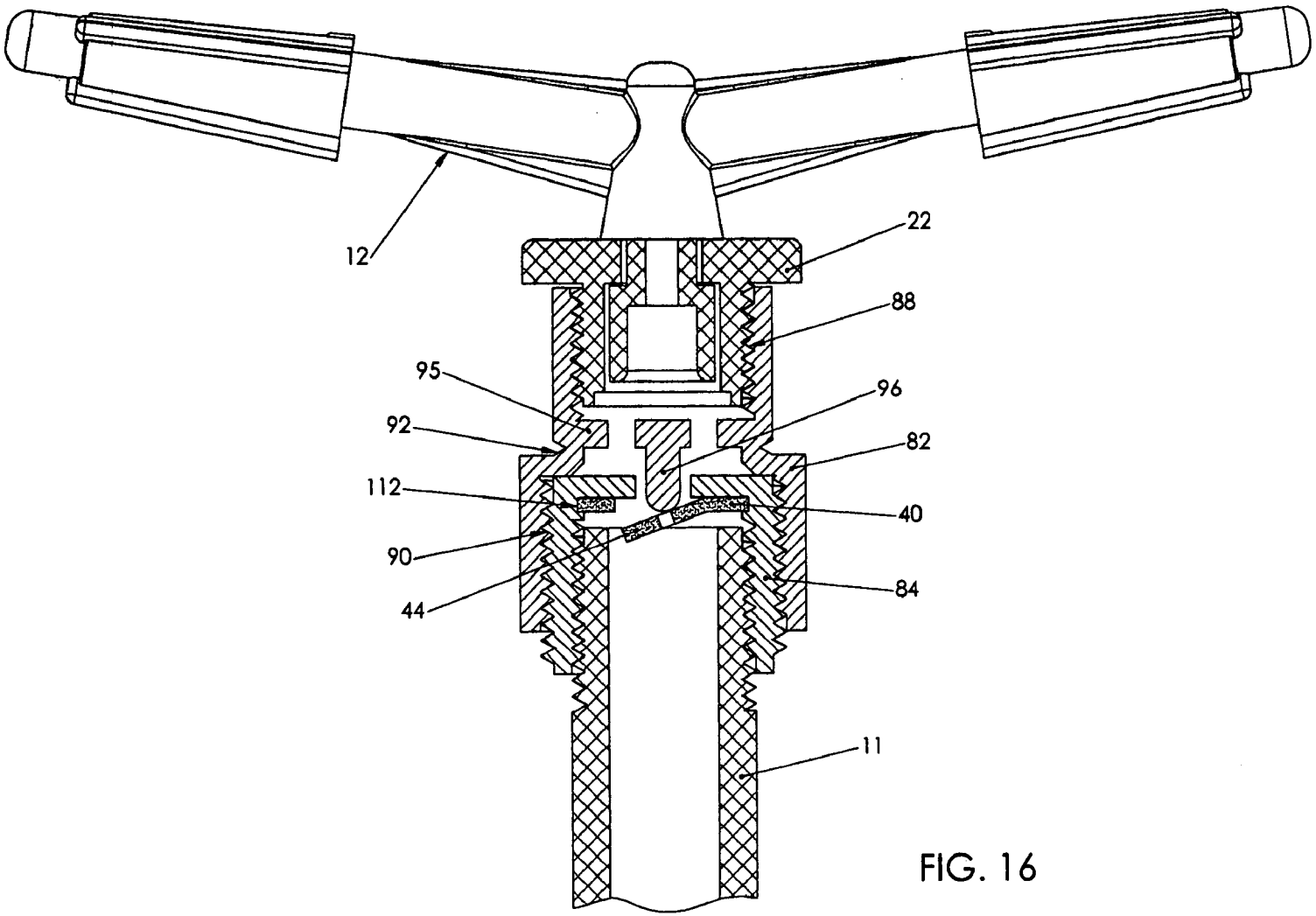
FIG. 16 is a view similar to FIG. 13, illustrating a modification in the mounting arrangement for the check valve of the embodiment of FIGS. 12 to 14.

In each of the above embodiments, the disc valve may be secured beneath the valve seat by the end of the riser or water supply pipe which is threaded into the coupling sleeve. Alternatively, the valve may be retained with a snap-ring or the like, or by the threads in the coupling sleeve, or it may be held in place in an annular groove in the coupling sleeve. FIG. 15 illustrates a modification of the embodiment of FIGS. 1 to 3 in which the valve 16 is of larger diameter and is designed to be snapped into engagement with an annular mounting groove 110 beneath the valve seat 15. In this case, the valve will be securely held in position against the valve seat regardless of whether the riser 11 is fully engaged in the coupling sleeve. The same mounting arrangement for the valve 16 or 40 may be used in any of the previous embodiments. FIG. 16 illustrates a modification of the break away embodiment of FIGS. 12 to 14 where the valve 40 is secured in an annular groove 112 in the inner body or sleeve 84. It will be understood that operation of the check valve will be exactly the same as described in the previous embodiments, with the only difference being the manner in which the valve is mounted in the coupling sleeve.

Figure 17:
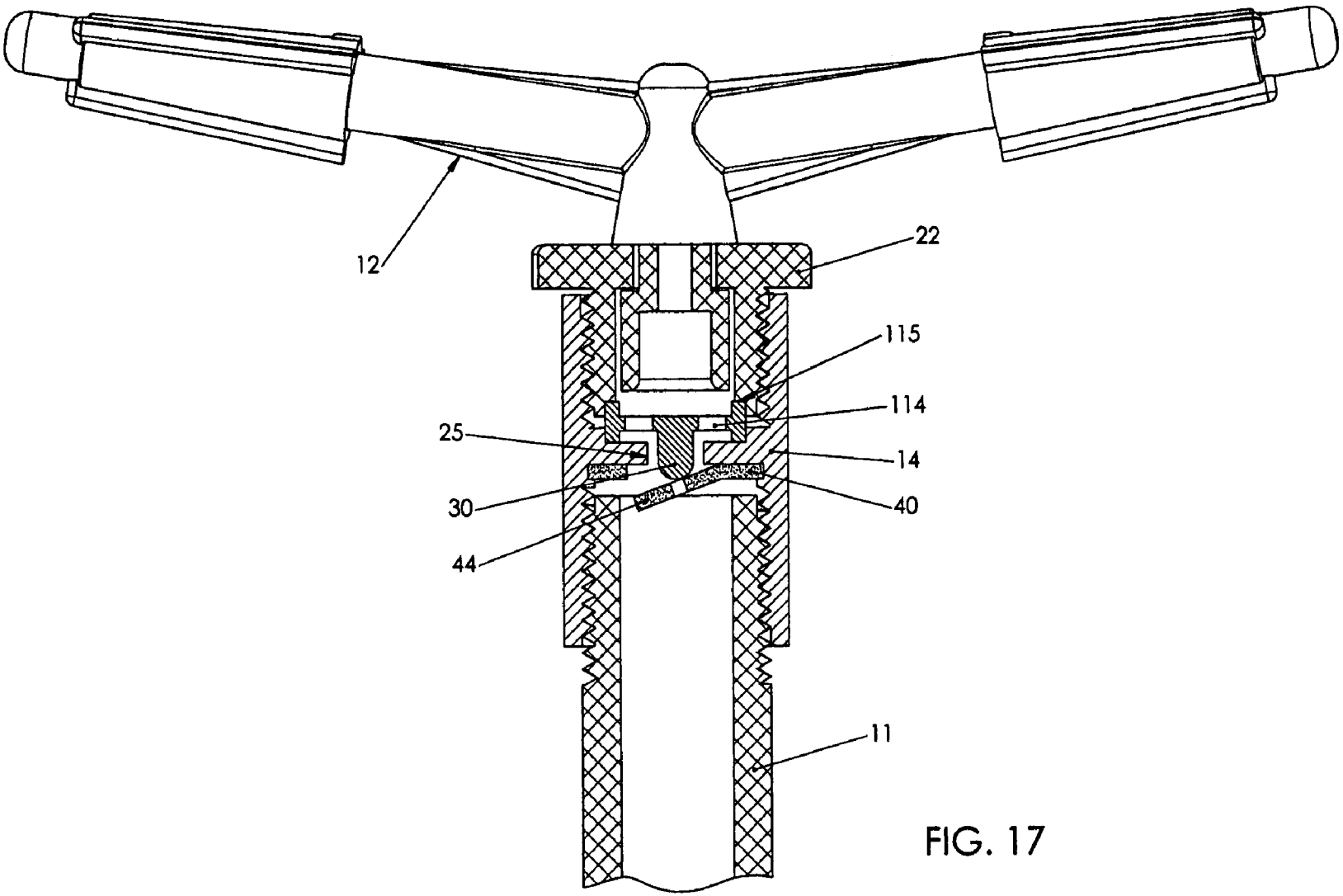
FIG. 17 is a view similar to FIG. 5, illustrating a modified valve and actuator mounting arrangement.
Figure 18:
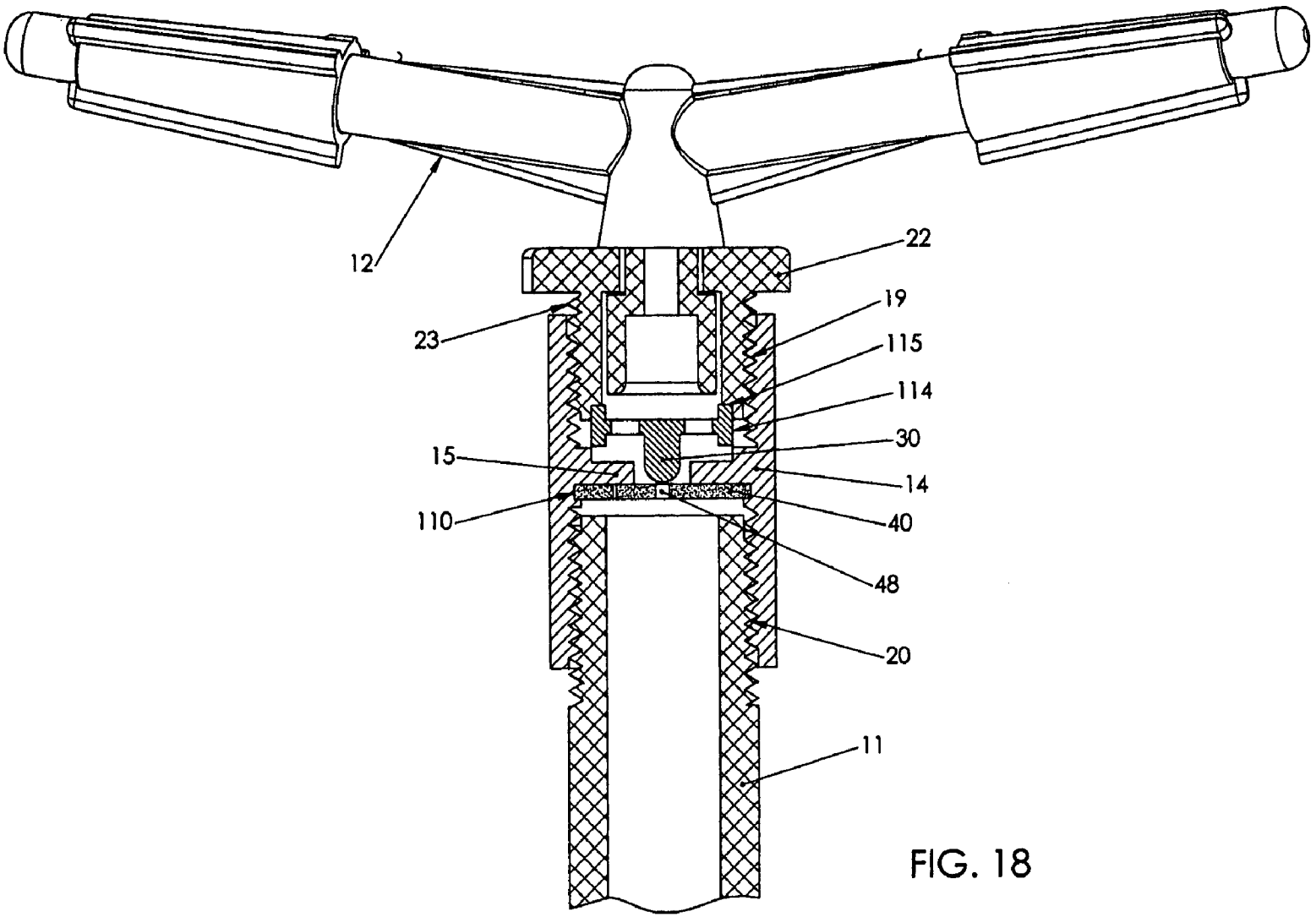
FIG. 18 is a view similar to FIG. 17, illustrating the valve in the closed position and the actuator in a retracted position.

FIGS. 17 and 18 illustrate a sprinkler head apparatus incorporating a check valve assembly which is a modification of the embodiment of FIG. 15. In this embodiment, the actuator 114 is of smaller diameter and is mounted differently from the second embodiment. Other parts are identical to the embodiment of FIGS. 5, 6 and 15, and like reference numerals have been used for like parts as appropriate. As in the embodiment of FIG. 15, the valve 40 in this embodiment is mounted in an annular mounting groove 110 beneath the valve seat in the coupling sleeve 14.

In the embodiments of FIGS. 1 to 6, 10, 11, and 15, the actuator was free floating and was simply trapped between the end of the sprinkler head base 22 and the valve seat 15. In this embodiment, the actuator 114 has its upper rim mounted in a mating seat 115 in the end of the sprinkler head base. The actuator is otherwise of similar structure to actuator 18 in the previous embodiments, and like reference numerals have been used as appropriate.

When the base 22 is fully engaged in the upper end of the coupling sleeve 14, the piston or pin 30 of actuator 114 will extend through the opening 25 in the valve seat and push the valve flap 44 into the open position, as illustrated in FIG. 17. When the sprinkler head is removed for replacement or maintenance, the actuator 114 will be removed along with the sprinkler head, and water pressure in outlet 11 will force the valve flap 44 into the closed position, as indicated in FIG. 18. It will be understood that the actuator may be mounted in a similar manner to that shown in FIGS. 17 and 18 in any of the embodiments of FIGS. 1 to 6, 11, 12, or 15.

Figure 19:
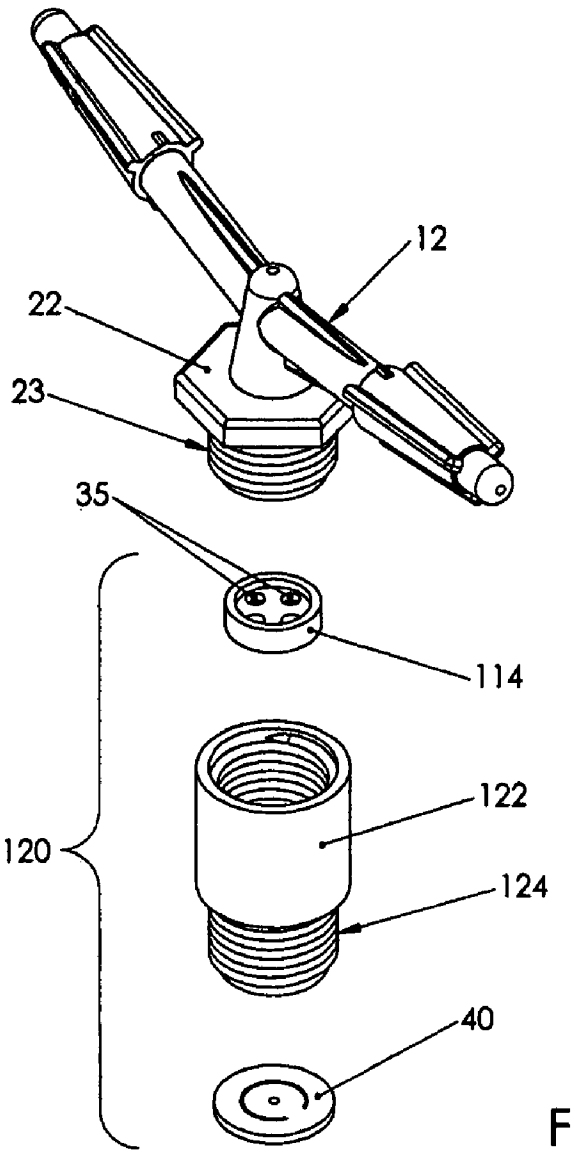
FIG. 19 is an exploded view of a sprinkler head apparatus with a check valve assembly according to another embodiment of the invention.
Figure 20:
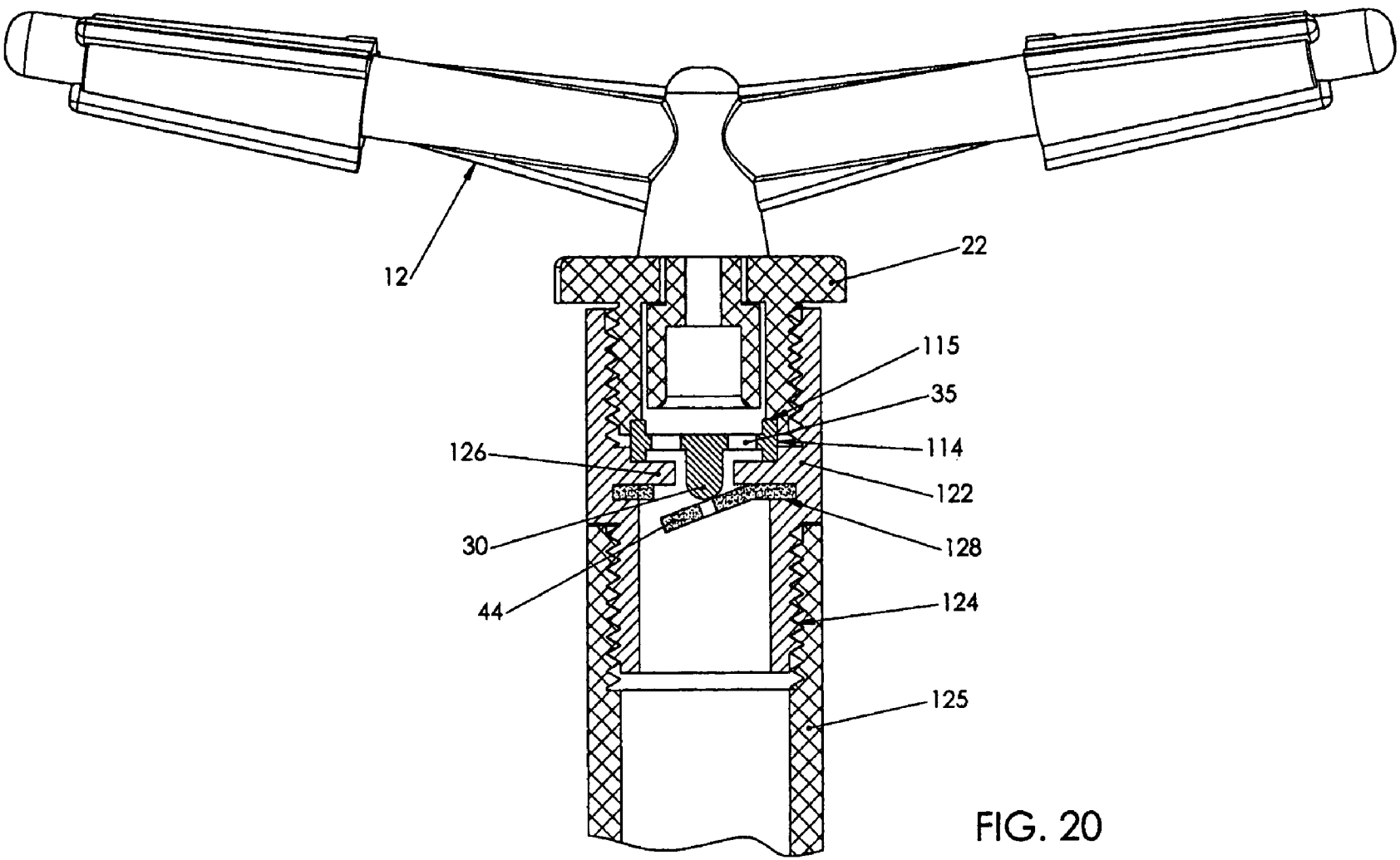
FIG. 20 is a vertical cross-sectional view of the assembled apparatus of FIG. 19, with the valve in the open position.
Figure 21:
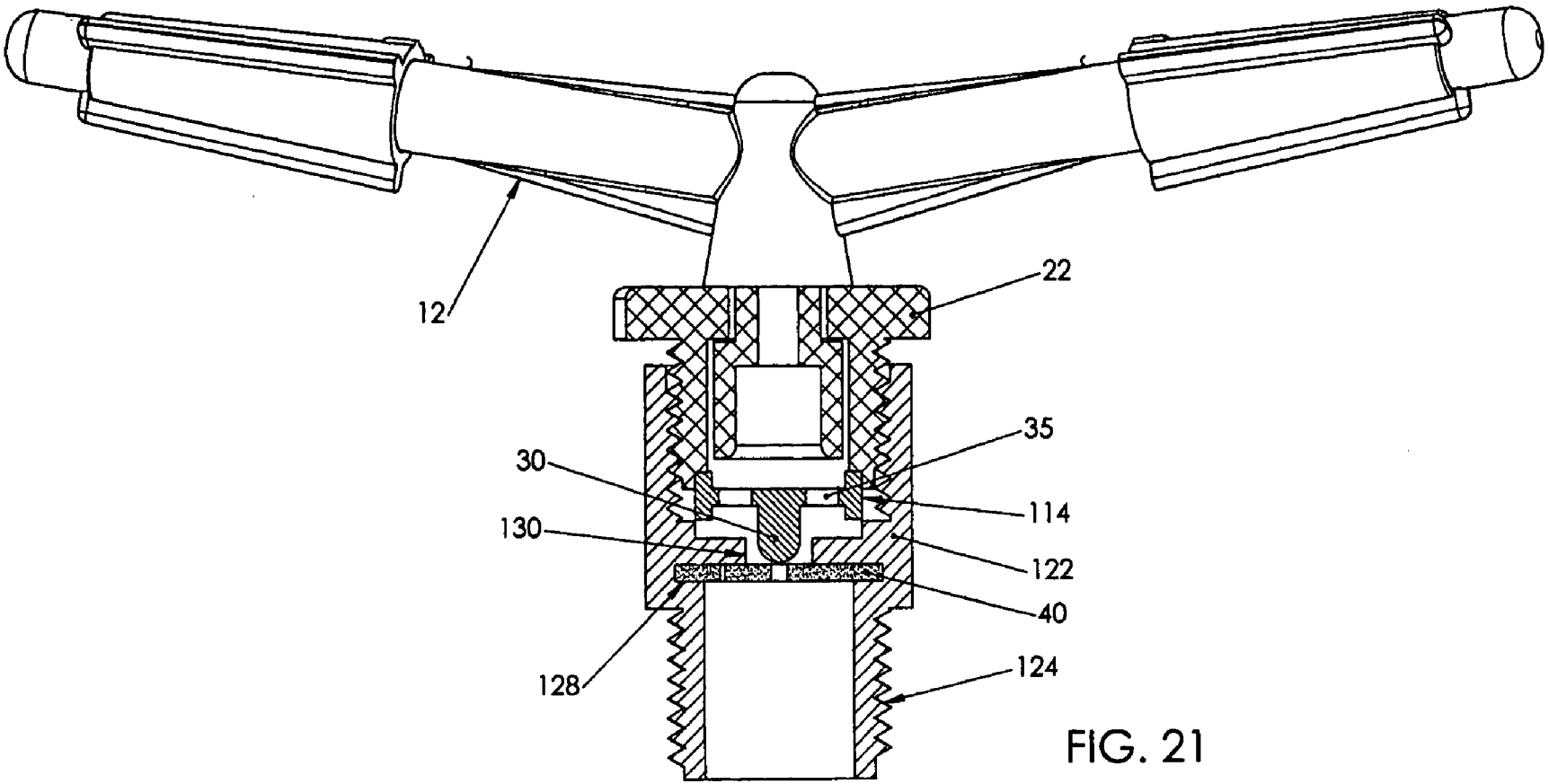
FIG. 21 is a view similar to FIG. 20 illustrating the valve in the closed position.

FIGS. 19 to 21 illustrate a check valve assembly 120 according to another embodiment of the invention for installation with a sprinkler head 12. This embodiment uses an actuator 114 and check valve 40 similar to some of the previous embodiments, but has a modified coupling sleeve or body 122 which has external threads 124 at its lower end, rather than internal threads as in the previous embodiments. This can be used when the riser pipe or water supply outlet 125 has internal threads rather than external threads (see FIG. 20). Although a flap valve 40 is illustrated, it will be understood that this valve may be replaced by a flexible disc valve 16 as in the embodiment of FIGS. 1 to 3 if desired.

As in the first embodiments, the coupling sleeve 120 has an internal valve seat 126 at an intermediate point in its length. Since the water supply outlet or riser 125 does not engage inside the lower end portion of sleeve 120, other means must be used to retain the valve 40 in position adjacent the seat. In this case, an annular mounting groove 128 is provided immediately beneath the seat 126, and the outer rim of valve 40 is seated in groove 128, as indicated in FIG. 20.

The actuator 114 is mounted in the end of the sprinkler head base 22 in a similar manner to the previous embodiment of FIGS. 17 and 18, but it may alternatively be a larger diameter actuator which is freely mounted between the base 22 and valve seat, as in the first two embodiments, or may be mounted on the end of a filter or the like. When the base 22 is fully engaged in the upper end of the coupling sleeve 120, the actuator piston 30 will extend through the opening 130 in the valve seat to push valve flap 44 into the open position, as illustrated in FIG. 20. If the sprinkler head and attached actuator 114 are removed, the water pressure in the water supply pipe 11 will force the flap 44 into the closed position, as illustrated in FIG. 21.

The check valve assembly of this invention can be readily installed in any sprinkler system with pop-up or fixed sprinkler heads, simply by connecting the coupling sleeve between the water supply and the base of the sprinkler head. In a number of the embodiments, the check valve is arranged to close automatically if the sprinkler head is removed for maintenance and to re-open when the sprinkler head is replaced. In other embodiments, the check valve closes automatically if the sprinkler head is broken, as in the embodiment of FIGS. 12 to 14, as well as when the sprinkler head is removed.

No separate biasing means is required to urge the check valve into the closed position. The water pressure in the system will close the valve. The check valve is a simple flat disc valve of resilient or semi-rigid material which has either a central region or a flap urged away from the valve seat by the actuator. The central region or flap will be urged back into the closed position on release of the actuator by the sprinkler head or on removal of the actuator with the sprinkler head. The valve may be manufactured simply and inexpensively by stamping from rubber material such as neoprene or the like, or may be molded from plastic material of a suitable hardness.

A small orifice may be provided at the center of the check valve. This will allow a small stream of water to exit the valve assembly when the valve is closed, facilitating cleaning of a screen filter if used in the assembly. Another advantage of a small central orifice in the valve is that a trickle of water will be seen after a sprinkler head has been broken off or removed, indicating to operators that the sprinkler needs to be repaired at that location. It is otherwise difficult to determine when sprinkler heads are broken or missing, particularly in a large irrigation area.

An advantage of the check valve assembly of this invention is that it allows a malfunctioning sprinkler head to be removed for repair or replacement without shutting down the entire sprinkler system. As soon as the sprinkler head is removed, the check valve closes automatically, shutting off the water supply. The valve will re-open automatically when the sprinkler head is replaced. Although the check valve assembly is described above for use with a sprinkler head of an irrigation or watering system, it may also be used in a hydraulic or pneumatic system, or any system in which a fluid is provided to an outlet head or tap. The check valve assembly in each case will shut off the supply to the outlet if the outlet head is removed for repair or replacement.

Although some exemplary embodiments of the invention have been described above by way of example only, it will be understood by those skilled in the field that modifications may be made to the disclosed embodiments without departing from the scope of the invention, which is defined by the appended claims.

I claim:

1. A fluid supply apparatus, comprising:

a flow passageway having a first end for connection to a fluid supply and an outlet end;

an outlet supply head releasably coupled to the outlet end of the flow passageway;

a valve seat within the flow passageway, the valve seat having a shoulder and a central opening;

a valve member mounted in the flow passageway on the opposite side of the valve seat to the outlet supply head, the valve comprising a disc having an outer periphery and a central portion, the outer periphery of the disc being held against the valve seat and the central portion being movable between an open position spaced from the valve seat and a closed position seated against the valve seat to close the central opening under pressure, the valve member having at least one opening which is open when the central portion of the valve member is in the open position; and an actuator mounted in the flow passageway between the outlet supply head and the valve seat, the actuator having a piston for projecting through the central opening in the valve seat to push the central portion of the valve disc into the open position when the actuator is in an operative position; the actuator being held in the operative position when the outlet supply head is coupled to the flow passageway.

2. The apparatus as claimed in claim 1, wherein the valve member comprises a substantially flat disc of resilient material, the central portion of the disc having a plurality of openings spaced outwardly from the opening in the valve seat when the valve member is in the closed position, the valve openings being urged against the valve seat when the valve member is closed.

3. The apparatus as claimed in claim 1, wherein the central portion of the valve member comprises a flap and a hinge securing the flap to the outer periphery of the valve member, the actuator urging the flap to pivot about the hinge and away from the valve seat in the operative position to open the valve opening, and the flap being urged by fluid pressure into the closed position when the actuator is released.

4. The apparatus as claimed in claim 1, wherein the actuator comprises a disc-shaped member having opposite first and second faces and a piston projecting from said second face, the actuator being slidably mounted in the first end of the coupling sleeve with the second face facing the valve seat and the piston extending through the seat to engage the valve member in the operative position.

5. The apparatus as claimed in claim 4, wherein the actuator has at least one opening for fluid flow through the actuator when the valve member is in the open position.

6. The assembly as claimed in claim 1, including a filter member mounted in the coupling sleeve between the outlet supply head and valve seat, the filter member having an end facing the valve seat, and the actuator comprising a projection from the end of the filter member, the projection extending through the valve seat and engaging the valve member in the operative position.

7. The assembly as claimed in claim 1, wherein the actuator is secured to the end of the outlet supply head.

8. The assembly as claimed in claim 1, wherein the actuator is of generally cross-shaped cross section having a central portion and a plurality of flanges projecting outwardly from said central portion, and a piston projecting from said central portion for extending through said valve seat and engaging the valve member in the operative position.

9. The apparatus as claimed in claim 1, wherein the fluid supply is a water supply and the outlet supply head is a sprinkler head.

10. The assembly as claimed in claim 9, wherein the valve member has a central opening for allowing a small amount of fluid to leak through the valve member when in the closed position.

11. The assembly as claimed in claim 9, wherein the first end of the coupling sleeve includes a breakaway portion having a line of weakness for breaking in the event of an impact on the sprinkler head, whereby the actuator is released and water supplied to the water supply outlet will urge the valve member into the closed position.

12. The assembly as claimed in claim 11, wherein the coupling sleeve comprises a first part at the first end connected to the sprinkler head and having said breakaway portion, and a second part at the second end for connection to a water supply outlet, the first part being releas ably secured to the second part, the valve seat being located in the second part and the valve member being mounted in the second part, the actuator being mounted in the first part and extending through the opening in the valve seat to contact the valve member in the operative position.

13. The assembly as claimed in claim 12, wherein the actuator is formed integrally with the first part of the coupling sleeve on the opposite side of the first part from the valve seat, such that the actuator is broken off along with the breakaway portion if the first part is broken along the line of weakness.

14. The assembly as claimed in claim 1, wherein the coupling sleeve has an annular mounting groove adjacent the valve seat, and the outer periphery of the valve member is releasably engaged in said mounting groove.

15. The apparatus as claimed in claim 1, wherein the second end of the coupling sleeve has an internally threaded portion for releasable threaded engagement with a fluid supply outlet, and the valve member has an outer periphery retained between the valve seat and supply outlet when a supply outlet is fully engaged in the second end of the coupling sleeve.

16. The assembly as claimed in claim 1, wherein the second end of the coupling sleeve has external threads for releasable threaded engagement with internal threads at the end of a fluid supply outlet.

17. A check valve assembly for a pop-up or fixed sprinkler head, comprising:

a coupling sleeve having a first end for connection to a sprinkler head and a second end for connection to a water supply, the coupling sleeve incorporating a valve seat, the valve seat having a shoulder and a central opening;

a disc valve mounted below the valve seat having a first portion retained adjacent the valve seat and a second portion movable between open and closed positions as a result of applied pressure; and a separate actuator movably mounted above the valve seat for movement between an operative position extending through the valve seat to hold the second portion of the disc valve in the open position;

the actuator being held in the operative position when a sprinkler head is connected to the first end of the coupling sleeve.

18. The check valve assembly as claimed in claim 17, wherein the sprinkler head is connected to the first end of the coupling sleeve by a break away sleeve;

wherein the break-away sleeve has a first end for connection to a sprinkler head and a second end releasably secured to the coupling sleeve, the break-away sleeve having a line of weakness at an intermediate point between the first and second ends for breaking in the event of an impact on a sprinkler head attached to the break-away sleeve;

wherein the actuator is mounted in the break-away sleeve on the opposite side of the line of weakness to the water supply and is released by breaking of the break-away sleeve along the line of weakness.

19. The assembly as claimed in claim 18, wherein the actuator is integrally mounted in the break-away sleeve and extends through the valve seat to hold the valve in the open position when the break-away sleeve and the coupling sleeve are secured together.

* * * * *